United States Patent [19]

Ludwig

[11] Patent Number: 4,496,244

[45] Date of Patent: Jan. 29, 1985

[54] SMALL VOLUME MIXING AND RECIRCULATING APPARATUS

[75] Inventor: Albert R. Ludwig, Holiday, Fla.

[73] Assignee: General Signal Corporation, Stamford, Conn.

[21] Appl. No.: 458,230

[22] Filed: Jan. 17, 1983

[51] Int. Cl.[3] ..... B01F 7/02; B01F 7/16; B01F 15/02

[52] U.S. Cl. ..... 366/136; 366/140; 366/165; 366/168; 366/279

[58] Field of Search ..... 366/136, 137, 140, 155, 366/159, 241, 279, 262, 264, 265, 270, 331, 165, 142, 168

[56] References Cited

U.S. PATENT DOCUMENTS

| | | | |
|---|---|---|---|
| 2,244,814 | 6/1941 | Underwood | 366/265 |
| 3,202,281 | 9/1965 | Weston | 261/93 |
| 3,212,757 | 10/1965 | Martin et al. | 366/165 |
| 3,278,271 | 10/1966 | Kono et al. | 261/93 |
| 3,421,477 | 1/1969 | Gilbert et al. | 366/137 |
| 3,505,029 | 4/1970 | Polgar et al. | 366/137 |
| 3,593,735 | 7/1971 | Reiher | 366/142 |
| 3,704,865 | 12/1972 | Kharitonov et al. | 366/137 |
| 3,806,004 | 4/1974 | Kolkovsky | 366/264 |
| 3,973,759 | 8/1976 | Mizrahi et al. | 366/264 |
| 4,002,325 | 1/1977 | Herfeld | 366/136 |
| 4,101,116 | 7/1978 | Haag et al. | 366/142 |

FOREIGN PATENT DOCUMENTS

| | | | |
|---|---|---|---|
| 1190437 | 4/1965 | Fed. Rep. of Germany | 366/270 |

*Primary Examiner*—Philip R. Coe

*Attorney, Agent, or Firm*—William G. Miller, Jr.; Harold Huberfeld

[57] ABSTRACT

The small volume recirculator includes a mixing chamber for receiving recirculated slurry from an inlet arranged to carry the slurry on its return path from the analyzer. An impeller is provided in a housing which is connected to the mixing chamber by way of an opening such that the housing receives the slurry from the reservoir through the opening and provides passage by way of an output tube to the analyzer. The connection between the housing and the chamber is sufficiently direct so that a vortex is set up in the mixing chamber. This provides the mixing. The impeller is rotatably mounted by shaft means which extends above the level of the slurry to a power drive train in avoidance of any shaft seals in the slurry path.

3 Claims, 4 Drawing Figures

FIG. 1
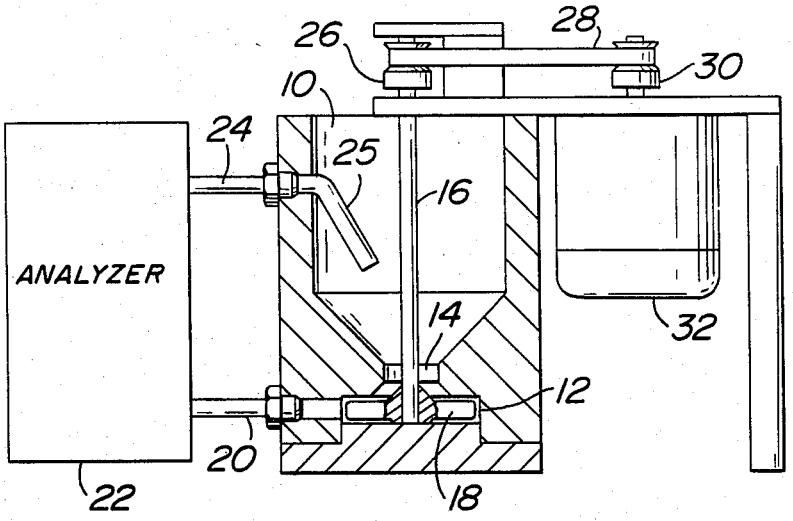
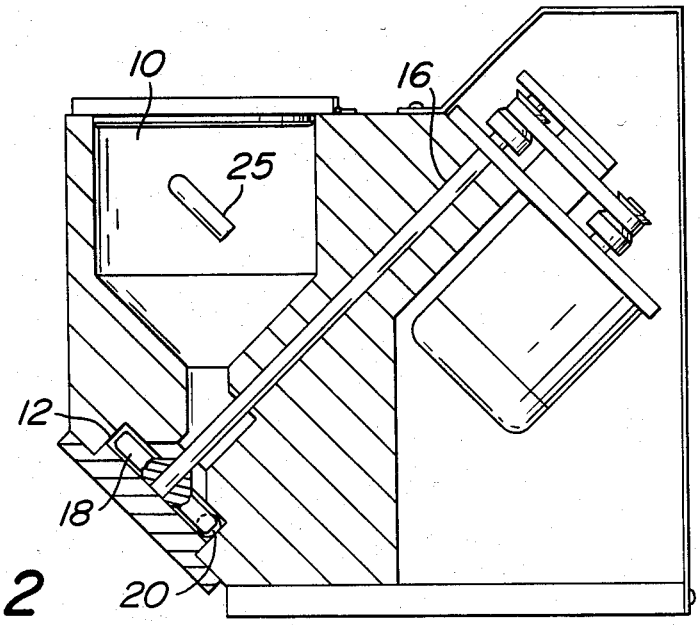
FIG. 2

FIG. 3
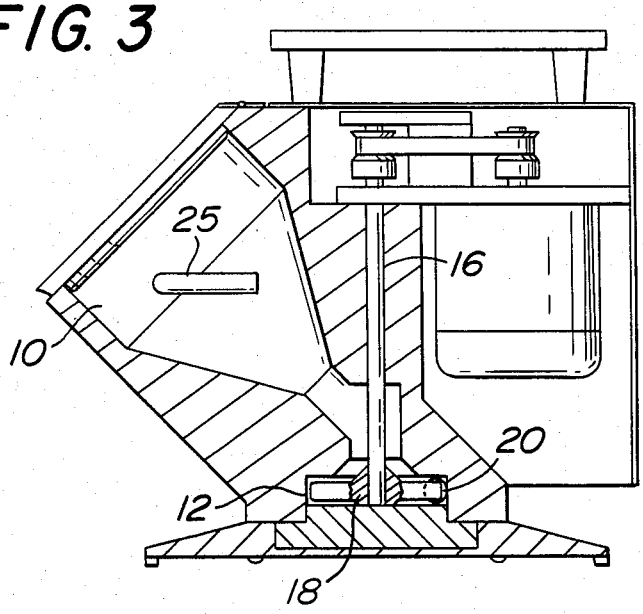
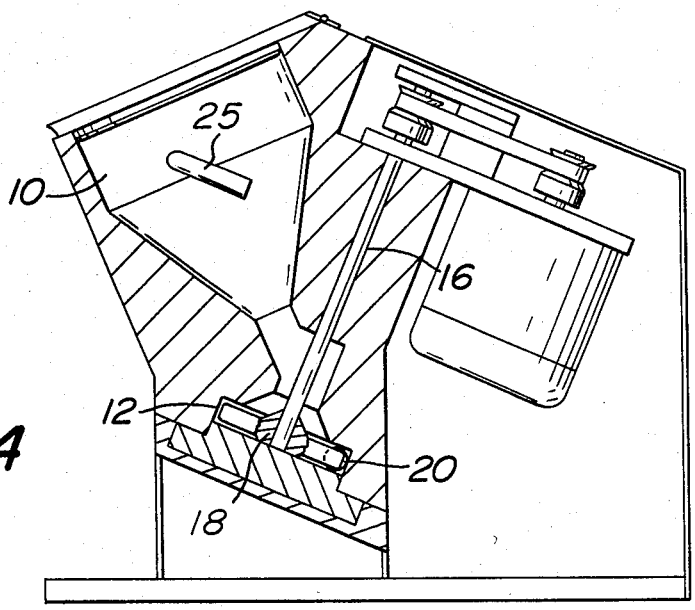
FIG. 4

SMALL VOLUME MIXING AND RECIRCULATING APPARATUS

BACKGROUND OF THE INVENTION

In the analysis of small particles as in determining their size by optical means, it is useful to prepare a slurry by suspending the particles in an organic solvent with constant stirring to provide a homogeneous suspension. The slurry is then constantly recirculated through the analyzer during analysis.

It is well known that a reservoir can advantageously be provided as a mixing chamber so that with a stirring impeller inserted into the reservoir the particles can be thoroughly mixed. The slurry with its suspended particles is pumped from the reservoir to the analyzer and then returned to the reservoir.

With recirculating apparatus such as that described above, it is difficult to provide a leak free system. Leaking is frequently encountered in the seals at the pump shaft particularly when organic solvents are involved. It is therefore an object of this invention to provide a recirculating mixing apparatus for small volumes of slurry constructed so as to avoid the need for shaft seals and with the capability of providing both stirring and pumping action with a single moving element.

SUMMARY OF THE INVENTION

In carrying out the object of this invention, there is provided a small volume recirculating apparatus designed for mixing and delivering from the mixing chamber to an analyzer a slurry having particles suspended therein. This apparatus includes a mixing chamber for receiving recirculated slurry from an inlet arranged to carry the slurry on its return path from the analyzer. An impeller is provided in a housing such that the housing receives the slurry from the reservoir through the opening and provides passage by way of an output tube to the analyzer. The connection between the housing and the chamber is sufficiently direct so that a vortex is set up in the mixing chamber. This provides the mixing. The impeller is rotatably mounted by shaft means which extends above the level of the slurry to a power drive train in avoidance of any shaft seals in the slurry path.

BRIEF DESCRIPTION OF THE DRAWINGS

In the drawings in which like elements refer to like parts:

FIG. 1 is a front elevation in cross section of one form of the novel recirculating apparatus wherein both the mixing chamber and the shaft means are vertically oriented.

FIG. 2 is another form of the novel recirculating apparatus in which the shaft means is contained in its own passage at an angle to the vertically oriented mixing chamber.

FIG. 3 is another form of the recirculating apparatus wherein the shaft means is in a passage of its own but is vertically oriented with the mixing chamber being oriented at an angle to the shaft.

FIG. 4 is still another embodiment of the novel invention in which both the shaft and the mixing chamber are at an angle to the vertical.

DESCRIPTION OF THE PREFERRED EMBODIMENT

In FIG. 1 there is shown a form of the novel recirculator apparatus wherein the vertically-oriented mixing chamber 10 forms a reservoir containing the slurry to be recirculated through an analyzer for analysis of the particles suspended therein. The mixing chamber 10 is connected to an impeller housing 12 by way of an opening 14 around the shaft 16. A centrifugal impeller 18 is rotatably mounted on the end of the shaft 16 in the impeller housing 12 so as to pump the slurry from the chamber 10 through the connected outlet tube 20 to the analyzer 22. The slurry after analysis in the analyzer 22 is returned to the mixing chamber by way of the inlet tube 24.

The opening 14 connecting the mixing chamber and the impeller housing is preferably big enough so that clearance is provided to pass the largest particles in the slurry.

Due to the intimate and direct connection between the mixing chamber and the impeller housing high speed rotation of the impeller sets up a vortex in the mixing chamber 10. This vortex serves to provide the mixing function. It is, of course, important that the vortex not be too well established in order to avoid drawing air into the impeller housing where air bubbles can be formed in the recirculating slurry. The assistance in maintaining the vortex in a condition which will avoid drawing air into the impeller housing, there is provided on inlet tube 24 a pivotable end 25 which can selectively be directed to cause the recirculated slurry to be directed with or against the vortex so as to enhance or diminish it.

As shown in FIG. 1, the shaft 16 is connected to a drive train which includes the pulley 26 which is driven by belt 28 from pulley 30 which in turn is connected to the shaft of the motor 32.

Since the arrangement shown in FIG. 1 does not require that the pump shaft exit from the recirculating system at a point below the level of the slurry, it is not necessary that there be any shaft seals and therefore the normal leakage problems which occur at shaft seals are avoided.

In the arrangement of FIG. 2, the shaft 16 is oriented at an angle to the vertical axis of the mixing chamber 10 so that the bottom of the impeller housing 12 is canted to the horizontal plane. This orientation is utilized in FIG. 2 to eliminate any dead flow space between the impeller 18 and the impeller housing in the area where the impeller axis intersects the fluid volume in the void (clearance) between the impeller and the impeller housing. The angle of cant should preferably be sufficient to allow particles to roll toward the periphery of the impeller housing under the influence of gravity.

In FIG. 3 the impeller shaft is oriented vertically as in FIG. 1 with the mixing chamber 10 being oriented at an angle such that the sides of the mixing chamber are inclined to the horizontal at a sufficiently large angle such that the particles in the slurry will roll under the influence of gravity to the bottom of the chamber and thence into the impeller housing 12.

FIG. 4 shows another arrangement wherein the shaft 16 and the mixing chamber 10 are both inclined at an angle to the vertical so that the benefits of both the arrangement of FIG. 2 and FIG. 3 are realized.

As will be evident from the drawings of FIGS. 2, 3, and 4, the outlet tube 20 is oriented tangent to the impeller housing 12 to receive the slurry. In these drawings the outlet 20 directs the slurry in a direction normal to the surface of the drawing.

What is claimed is:

1. A small volume mixing and delivery system for supplying small particles suspended in a vehicle so as to form a slurry for delivery and recirculation, comprising:

a mixing chamber having cylindrical sides, a conical bottom having an opening at its lowest point and a pivotable inlet tube adjustable to introduce recirculated slurry into said chamber in a manner to selectively enhance or diminish the establishment of a vortex in said chamber;

a high speed rotatable impeller;

an outlet tube;

an impeller housing encasing said impeller and connected to said chamber at said opening and to said outlet tube, said opening being such that the housing receives the slurry from the mixing chamber and closely couples the housing with the mixing chamber so that the high speed rotation of the impeller coupled with the force of the recirculated slurry produces a vortex in said chamber for mixing said slurry in the chamber while the impeller pumps said slurry through said outlet tube;

shaft means for rotating said impeller in said housing, said shaft means extending through said slurry to a point above the level of said slurry for connection to a power drive train arranged to drive said impeller.

2. Apparatus as set forth in claim 1 in which the shaft means extends upward through the mixing chamber.

3. Apparatus as set forth in claim 2 in which the clearance provided by said opening is greater than the largest dimension of the largest particle suspended in the slurry and the cross section of the inlet tube is larger than that of the outlet tube by a minimum of 25%.

* * * * *